US006421508B2

(12) United States Patent
Inoue et al.

(10) Patent No.: US 6,421,508 B2
(45) **Date of Patent: *Jul. 16, 2002**

(54) SYSTEM FOR PREVENTING RETRANSFER OF A TONER IMAGE BETWEEN AN INTERMEDIATE TRANSFER MEMBER AND AN IMAGE BEARING MEMBER

(75) Inventors: Masahiro Inoue; Motohide Shiozawa, both of Mishima; Yoshikuni Ito, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/382,603

(22) Filed: Aug. 25, 1999

(30) Foreign Application Priority Data

Aug. 31, 1998 (JP) ..... 10-246349

(51) Int. Cl.[7] ..... G03G 15/00

(52) U.S. Cl. ..... 399/44; 399/50; 399/97; 399/302; 399/308

(58) Field of Search ..... 399/44, 43, 66, 399/26, 94, 96, 97, 156, 50, 302, 308, 39

(56) References Cited

U.S. PATENT DOCUMENTS

| | | | | | |
|---|---|---|---|---|---|
| 5,160,967 | A | * | 11/1992 | Tonegawa | 399/26 |
| 5,298,943 | A | * | 3/1994 | Ide et al. | 399/222 |
| 5,485,248 | A | * | 1/1996 | Yano et al. | 399/168 |
| 5,701,551 | A | * | 12/1997 | Honda et al. | 399/50 |
| 5,740,500 | A | * | 4/1998 | Hashimoto | 399/114 |
| 5,784,668 | A | * | 7/1998 | Hyakutake et al. | 399/44 X |
| 5,812,905 | A | * | 9/1998 | Yoo | 399/50 |
| 5,852,756 | A | * | 12/1998 | Teranishi et al. | 399/44 |
| 5,907,739 | A | * | 5/1999 | Tsunemi et al. | 399/26 |

* cited by examiner

*Primary Examiner*—Quana M. Grainger
(74) *Attorney, Agent, or Firm*—Fitzpatrick, Cella, Harper & Scinto

(57) ABSTRACT

The present invention relates to an image forming apparatus in which voltage is applied to an intermediate transfer body when a toner image is transferred from an image bearing body to the intermediate transfer body, and a controller controls variably a potential of a shadow portion of an electrostatic image so that a potential difference between the potential of the shadow portion and the voltage can be variable on the basis of a detected result of a detecting circuit.

20 Claims, 5 Drawing Sheets

SYSTEM FOR PREVENTING RETRANSFER OF A TONER IMAGE BETWEEN AN INTERMEDIATE TRANSFER MEMBER AND AN IMAGE BEARING MEMBER

BACKGROUND OF THE INVENTION

1. Field of the Invention

The present invention relates to an image forming apparatus such as an electrophotographic copying machine, a laser beam printer, etc. employing an intermediate transfer body.

2. Related Background Art

An image forming apparatus of full color including four colors shown in FIG. 5, such as a copying machine, a laser beam printer, etc. employs an intermediate transfer body 5 as a second image bearing body outside a photosensitive drum 1 serving as a first image bearing body. It has been known that the image forming apparatus using the intermediate transfer body 5 has very little color misregistration of a color image formed by superposing toner images having a plurality of colors.

In the image forming apparatus illustrated in FIG. 5, the surface of the photosensitive drum 1 is a first image bearing body which rotates in the direction shown by an arrow mark R1 and is uniformly charged by a charging roller 2 so as to have a prescribed polarity and a prescribed potential. The surface of the charged photosensitive drum 1 is scanned and exposed with a laser beam L corresponding to yellow by an exposure device 3 to form an electrostatic latent image thereon. This electrostatic latent image has yellow toner adhered thereto by the yellow developer 4*a* of a developing device 4 and is developed as a toner image. The yellow toner image is primarily transferred to the surface of the intermediate transfer body 5 rotating in the direction of an arrow mark R5 through a primary transfer nip $T_1$. The toner which is not transferred to the intermediate transfer body 5 but remains on the surface of photosensitive drum 1 after the primary transfer is removed by a cleaning device 7*a*.

The same image forming processes as those mentioned above are also repeated for three colors other than yellow, that is to say, magenta, cyan and black, so that the toner images of four colors are superposed on the intermediate transfer body 5 to form color images.

The color images are simultaneously secondarily transferred to a transfer material P through a secondary transfer nip $T_2$ by a transfer roller 8 to which secondary transfer bias applied power 10*b* is applied. The transfer material P to which the color images are secondarily transferred is conveyed to a fixing device 9. In the fixing device 9, the transfer material P is heated and pressed so that the color images are fixed to the surface thereof. On the other hand, after the transfer of the toner image, toner remaining after the secondary transfer which is not transferred to the transfer material P but remains on the surface of the intermediate transfer body 5 is removed by a cleaning device 7*b*.

Referring to FIG. 5, reference characters 4*b*, 4*c* and 4*d* respectively designate the developers of magenta, cyan and black in an order described above. Further, 10*a* is a controller for controlling the secondary transfer bias applied power 10*b*.

In the above described image forming apparatus, the primary transfer of the toner image to the intermediate transfer body 5 from the photosensitive drum 1 is repeated four times, then, the toner images of four colors are superposed on the intermediate transfer body 5 and these toner images (color images) are simultaneously secondarily transferred onto the transfer material P. Therefore, this image forming apparatus is referred to as a multiple transfer type image forming apparatus.

In the multiple transfer type image forming apparatus mentioned above, however, the toner images have been superposed on the intermediate transfer body 5 and repeatedly transferred thereto, hence there has sometimes appeared a phenomenon called a retransfer that the toner image which has been already transferred to the intermediate transfer body 5 has been retransferred to the photosensitive drum 1 during the transfer process of a next color. If this retransfer phenomenon is generated, the density of an image will be lowered and a defective image will be undesirably formed.

The above retransfer phenomenon is typically generated under conditions mentioned below. As the number of times of primary transfer is increased after the toner image is transferred to the intermediate transfer body 5 from the photosensitive drum 1, this retransfer phenomenon is more liable to be generated, because the charged polarity of toner is apt to be reversed due to a plurality of times of transfers. For example, in the above conventional case, since the yellow toner image corresponds to a first color, the yellow toner image is retransferred to the photosensitive drum during the transfer of second to fourth colors.

Further, the retransfer phenomenon is apt to be generated when a reversal developing method is employed and there is no toner on the photosensitive drum 1 upon generation of a retransfer phenomenon: that is to say, this phenomenon tends to be generated on the white background part or the shadow portion of the photosensitive drum. Specifically, the potential difference of the shadow portion of the photosensitive drum 1 is large relative to transfer voltage applied to the intermediate transfer body and large transfer current is supplied thereto, so that the charged polarity of toner is readily reversed.

Further, the retransfer phenomenon is liable to be generated in the environment of high humidity in which large transfer current is apt to be supplied.

Furthermore, the lower the resistance value of the intermediate transfer body 5, the more easily the retransfer phenomenon is generated.

To summarize the above description, the retransfer phenomenon indicates that the transfer current is excessively supplied so that the charged polarity of toner is reversed to an ordinary charged polarity, and therefore, the toner returns to the photosensitive drum 1.

SUMMARY OF THE INVENTION

Accordingly, it is an object of the present invention to provide an image forming apparatus capable of preventing a retransfer phenomenon in which a toner image temporarily transferred to an intermediate transfer body returns to an image bearing body.

It is another object of the present invention to provide an image forming apparatus capable of preventing a toner image of a certain color transferred to an intermediate transfer body from returning to an image bearing body upon transfer of toner images of other colors after the first color to the intermediate transfer body.

It is still another object of the present invention to provide an image forming apparatus capable of decreasing the potential difference between the potential of a shadow portion and transfer voltage by decreasing the thickness of the layer of an image bearing body and reducing the potential of the shadow portion of the image bearing body under the environment of high humidity.

DETAILED DESCRIPTION OF THE PREFERRED EMBODIMENTS

Now, referring to accompanying drawings, an explanation will be given to embodiments of the present invention.

First Embodiment

Figure 1:
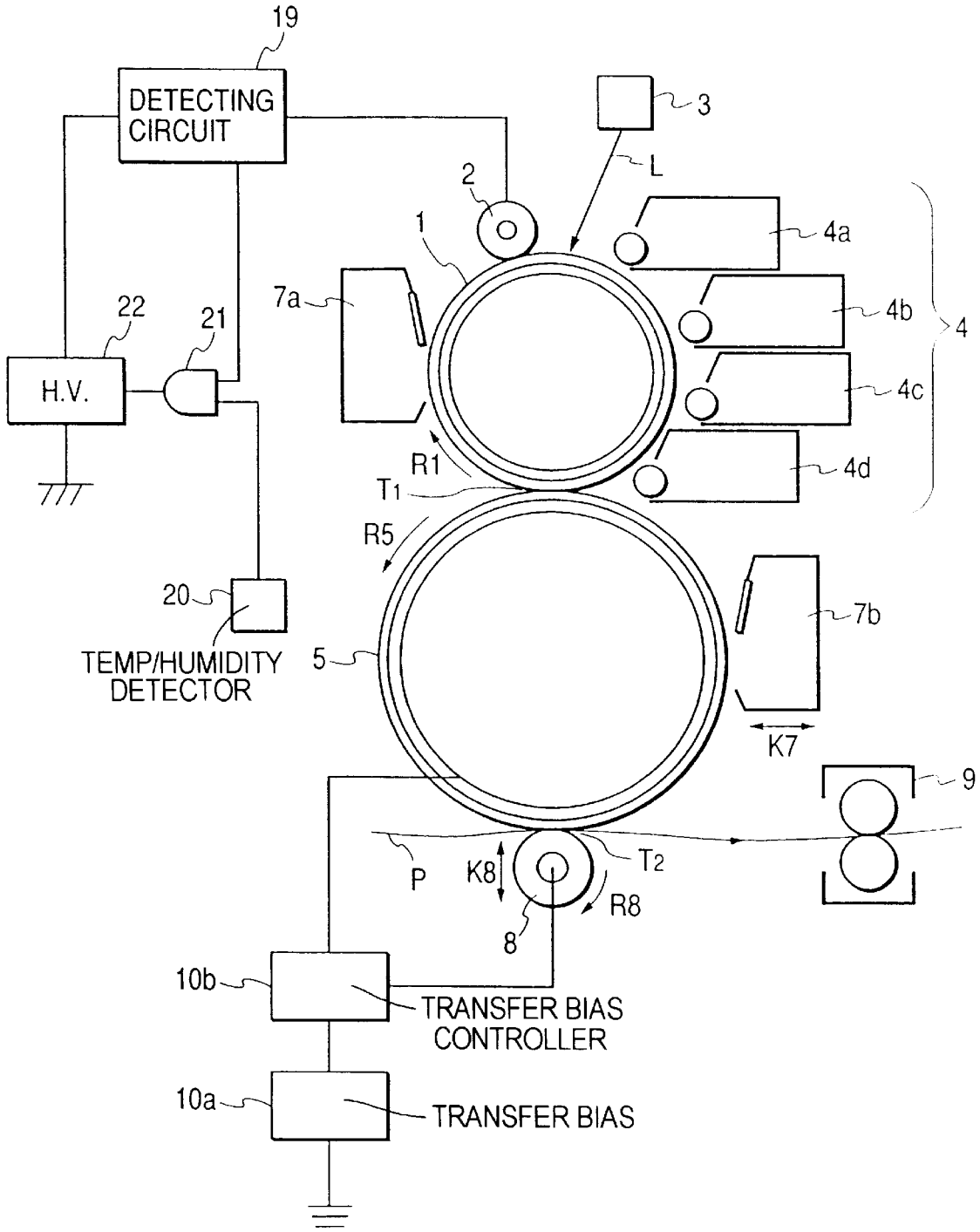
FIG. 1 is a longitudinally sectional view showing the schematic configuration of an image forming apparatus according to a first embodiment of the present invention.

FIG. 1 shows an example of an image forming apparatus according to the present invention. The image forming apparatus shown in FIG. 1 is a laser beam printer of full color including four colors. FIG. 1 is a longitudinally sectional view showing a schematic configuration thereof.

The image forming apparatus is provided with a drum type electrophotographic photosensitive body (referred it to as a photosensitive drum, hereinafter) 1 as a first image bearing body. The photosensitive drum 1 is driven to rotate in the direction shown by an arrow mark R1 by driving means (not shown). On the periphery of the photosensitive drum 1, a charging roller 2, an exposure device 3, a developing device 4 having a plurality of developers 4*a*, 4*b*, 4*c* and 4*d*, an intermediate transfer body 5 as a second image bearing body, a cleaning device 7*a* or the like are arranged substantially regularly along the rotating direction of the photosensitive drum 1. In the periphery of the intermediate transfer body 5, a cleaner 7*b* and a transfer roller 8 or the like are provided. Further, a fixing device 9 is provided in the downstream side of the transfer roller 8 along the conveying direction of a transfer material P.

To the above described intermediate transfer body 5 and the transfer roller 8, is connected a transfer bias applied power 10*b* controlled by a controller 10*a*. As the intermediate transfer body 5, one whose resistance value is as low as $10^8$ Ω or lower may be frequently used by taking transfer characteristics upon secondary transfer into consideration.

For forming a color image, the photosensitive drum 1 is first driven to rotate at prescribed circumferential speed (process speed) in the direction shown by an arrow mark R1. The surface of the photosensitive drum 1 is uniformly primarily charged so as to have a prescribed polarity and prescribed potential by the charging roller 2 serving as a charging member, and scanned and exposed with a laser beam L by the exposure device 3. Thus, an electrostatic latent image of a first color (yellow) is formed on the photosensitive drum 1 and the electrostatic latent image is developed by the developing device 4.

The developing device 4 is integrally provided with first, second, third and fourth developers 4*a*, 4*b*, 4*c* and 4*d* in which toner of colors including yellow, magenta, cyan and black is housed respectively. The developer employed for developing the electrostatic latent image on the photosensitive drum 1 abuts on the photosensitive drum 1 and the developers other than the above developer is separated from the photosensitive drum 1. The yellow toner is applied to the first electrostatic latent image by the first developer 4*a* so that the first latent image is visualized as a yellow toner image.

In the case when the electrostatic latent image is formed in a digital system as mentioned above, a developing system referred to as, what is called a reversal developing system has been frequently utilized lately. According to this reversal developing system, after the surface of the photosensitive drum 1 is charged with a minus polarity, for instance, upon primary charging as described above, an image part is exposed to decrease the electrified charge of that part and toner charged with the same polarity as that at the time of primary charging is developed in the exposed part.

Voltage with a polarity reverse to the charged polarity of toner is applied to the intermediate transfer body 5 by the transfer bias applied power lob in a primary transfer nip $T_1$ formed by the photosensitive drum 1 and the intermediate transfer body 5 which comes into contact with the photosensitive drum 1, so that the yellow toner image thus obtained is primarily transferred to the surface of the intermediate transfer body 5 in an electrostatic manner. The photosensitive drum 1 which completes a primary transfer operation is, after the toner slightly remaining on the surface of the photosensitive drum 1 (the toner remaining after the primary transfer) is removed by the cleaning device 7*a*, used for forming an image of a next color.

In a similar manner to the above, the photosensitive drum 1 undergoes the primary charging by the charging roller 2 and the exposure with the laser beam L by the exposure device 3, so that an electrostatic latent image of a second color is formed thereon. The latent image is developed by the second developer 4*b* and the toner image of magenta is formed on the photosensitive drum 1. The magenta toner image is primarily transferred onto the intermediate transfer body 5 in the primary transfer nip $T_1$, so as to be superposed on the yellow toner image.

A sequence of image forming processes similar to that described above are also repeated for remaining cyan and black, and a cyan toner image obtained from the development of the third developer 4*c* and a black toner image obtained from the development by the fourth developer 4*d* are sequentially primarily transferred to be superposed on the surface of the intermediate transfer body 5. In this manner, the color image having the toner images of four colors such as yellow, magenta, cyan and black laminated is formed on the surface of the intermediate transfer body 5.

After that, the transfer roller 8 separated from the intermediate transfer body so as to be movable in the direction shown by an arrow mark K8 abuts on the surface of the intermediate transfer body 5 to constitute a secondary transfer nip $T_2$. Voltage with a polarity reverse to the charged polarity of the toner is applied to the transfer roller 8 from the transfer bias applied power 10*b*, so that in the second transfer nip $T_2$ the toner images of four colors (the color image) formed on the intermediate transfer body 5 are secondarily transferred at the same time onto the surface of the transfer material P as a third image bearing body which is conveyed at a prescribed timing.

The transfer material P to which the toner images of four colors are transferred is conveyed to the fixing device 9 from the intermediate transfer body 5, heated and pressed therein by a fixing roller 9*a* having a heater and a pressing roller 9*b* in contact therewith under pressure. The transfer material P has the toner images (the color image) of four colors fixed on its surface to have a permanent image. Then, the transfer material P is discharged outside the image forming apparatus so that the image is completely formed. After the small quantity of toner (toner remaining after the secondary transfer) remaining on the surface of the intermediate transfer body 5 in which the secondary transfer operation is finished is removed by the intermediate transfer body cleaner 7*b* operative at a prescribed timing relative to the intermediate transfer body 5, the intermediate transfer body 5 is prepared for forming a next image.

Turning now to the above described problem, that is to say, concerning the generation mechanism of the retransfer phenomenon, the results of study of the applicant and other staff of the present application will be described hereinafter.

Figure 2:
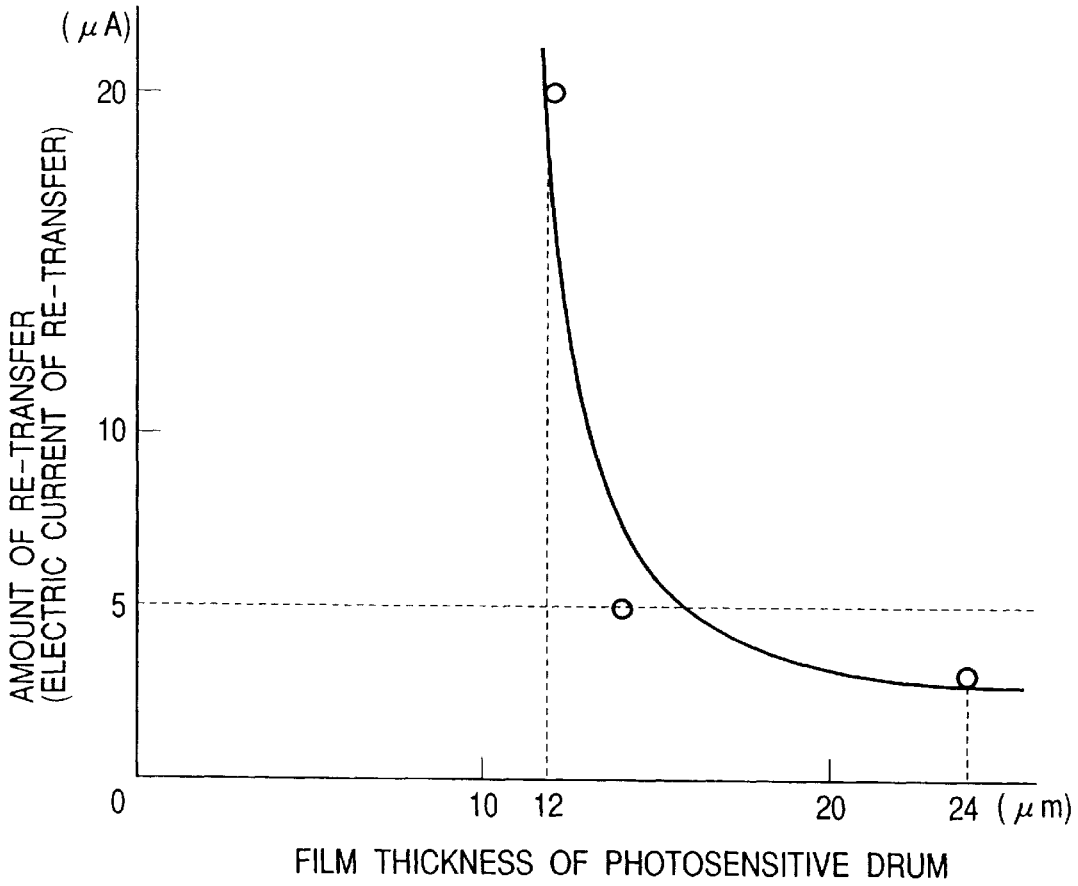
FIG. 2 is a diagram showing the relation between the film thickness of a photosensitive drum and the amount of retransfer under the environment of high humidity.

Initially, referring to FIG. 2, assuming that potential Vd corresponding to the white background part (a shadow portion) of the photosensitive drum 1 under the environment of high temperature and high humidity (temperature is 30° C. and relative humidity is 80%) is −600V (Since the reversal developing system is employed, potential V1 corresponding to a black background part (light portion) is substantially −200V), and transfer voltage Vtr in the primary transfer nip $T_1$ is +300V, the relation between the film thickness of the photosensitive drum 1 and the amount of generation of the retransfer phenomenon is shown.

In FIG. 2, as the photosensitive drum 1, an OPC (organic photo semiconductor) photosensitive body is used. Here, the "film thickness" indicates a film thickness of an organic material layer for exhibiting a photosensitive characteristic provided on a core metal such as aluminium serving as the base substance of the photosensitive drum 1, which is generally called a charge transporting layer and ordinarily formed on the outermost layer of the photosensitive drum 1. The charge transporting layer ordinarily formed on the outermost layer of the photosensitive drum 1 is gradually scraped under the sliding friction of the cleaning blade or the like of the cleaning device 7*a* as a cleaning member and the film thickness thereof is decreased, as a result of use of the photosensitive drum 1 for a long time. As apparent from FIG. 2, at an initial time, the film thickness of the photosensitive drum 1 is 24 μm, however, after the formation of images is completed on 50 K sheets (50,000 sheets) of A4 size which are fed transversely, the film thickness becomes consequently 12 μm.

Further, the amount of generation of the retransfer phenomenon indicates the transfer current (referred it to as "electric current of retransfer," hereinafter) supplied in the primary transfer nip $T_1$, during the retransfer operation having a great correlation to the amount of toner to be retransferred.

As a result of the study of the applicant and other staff of the present application, it has been clarified that the toner of retransfer is undesirably increased from a part or thereabout in which the electric current of retransfer exceeds 5 μA (illustrated by a dotted line in FIG. 2) to a level which causes a difficulty in its practical use, so that defective or incomplete images are formed.

Now, as understood from FIG. 2, as the film thickness of the photosensitive drum 1 is decreased, the amount of generation of the retransfer phenomenon is increased. In other words, under the conditions in which the potential Vd of the photosensitive drum 1 is −600 V, and the primary transfer voltage Vtr is +300V, when the formation of images on 40 K sheets (40,000 sheets) or so is completed (when the film thickness of the photosensitive drum 1 is lower than 60% as thick as the film thickness thereof at the initial time), the poor copy appears.

Figure 3:
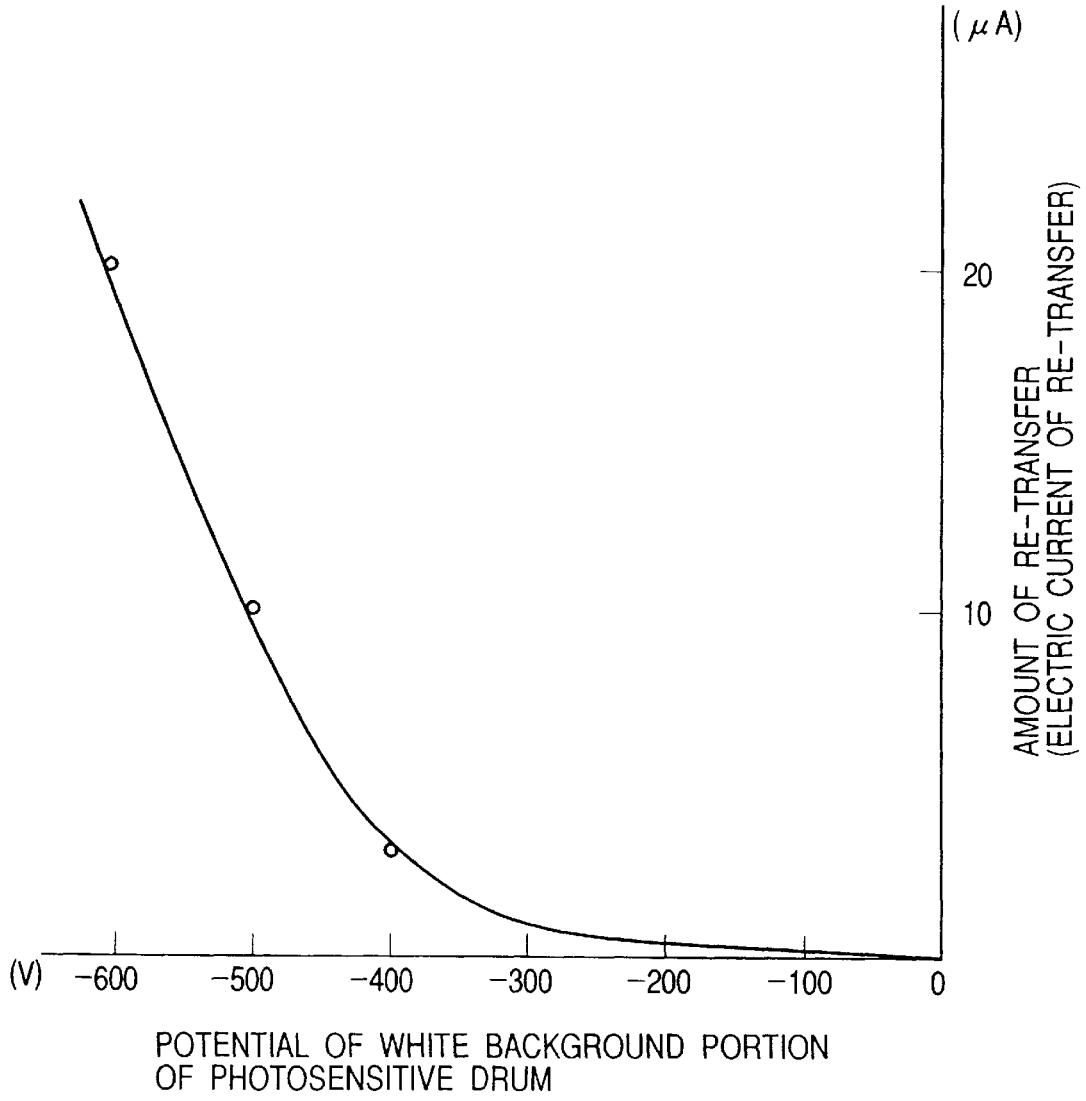
FIG. 3 is a diagram showing the relation between the potential of a white background part of the photosensitive drum and the amount of retransfer under the environment of high humidity.

Next, referring to FIG. 3, is shown the relation between the potential Vd of the photosensitive drum 1 using the primary transfer voltage Vtr=+300V and the amount of generation of the retransfer phenomenon by employing the photosensitive drum which has completely carried out the formation of images on the above mentioned 50 K sheets. As apparent from FIG. 3, when the absolute value of the potential Vd of the photosensitive drum 1 is increased, the amount of generation of the retransfer phenomenon is increased. As described above, in case the reversal developing system is employed, the difference between transfer bias voltage and the potential of the white background portion of the photosensitive drum 1 is larger than that of a normal developing system, and therefore, an abnormal discharge is extremely apt to be generated in the primary transfer nip $T_1$. Then, toner may be possibly reversely charged and the retransfer phenomenon may be generated because of this abnormal discharge.

In this connection, there is a positive correlation between the amount of generation of the abnormal discharge phenomenon and the generation of the retransfer phenomenon. If the film thickness of the photosensitive drum 1 is decreased or the absolute value of the potential of the white background part of the photosensitive drum 1 is increased, the abnormal discharge phenomenon will be apparently more generated.

Here, assuming that the quantity of electric charge per unit area of the photosensitive drum 1 is vs($Q/m^2$), the dielectric constant of the charge transporting layer of the photosensitive drum 1 is ϵd, and vacuum dielectric constant is ϵ0, a relation expressed by the following formula (1) is established between the film thickness t(m) of the photosensitive drum 1 and the surface potential Vd (V).

$$\sigma s=\epsilon O\cdot\epsilon d\cdot Vd/t \ldots \quad (1)$$

Therefore, the more the film thickness of the photosensitive drum 1 is decreased, the more the absolute value of Vd as well as σs is increased.

More specifically, the above description results in a fact that the more the quantity of electric charge existing on the photosensitive drum 1 is increased, the more the retransfer phenomenon is apt to be generated.

Further, according to the result of study carried out so far, it may be said that the retransfer phenomenon reaches a level at which the image forming apparatus is employed with trouble in its practical use, because there exists a certain threshold value (in the system described in this embodiment, the current value of retransfer is substantially 5 μA).

Therefore, when the film thickness t of the charge transporting layer which is located in the outermost layer is decreased as a result of using the. photosensitive drum 1, the absolute value of the potential Vd of the photosensitive drum 1 is controlled to be a prescribed amount or lower and the quantity of charge as on the photosensitive drum 1 is controlled to be a prescribed quantity (a level at which the retransfer phenomenon is not generated) or lower, so that the generation of the retransfer phenomenon can be reduced and prevented.

Now, a specific example will be described in order to cope with the above described problems by taking the above mentioned generation mechanism of the retransfer phenomenon into consideration.

Figure 5:
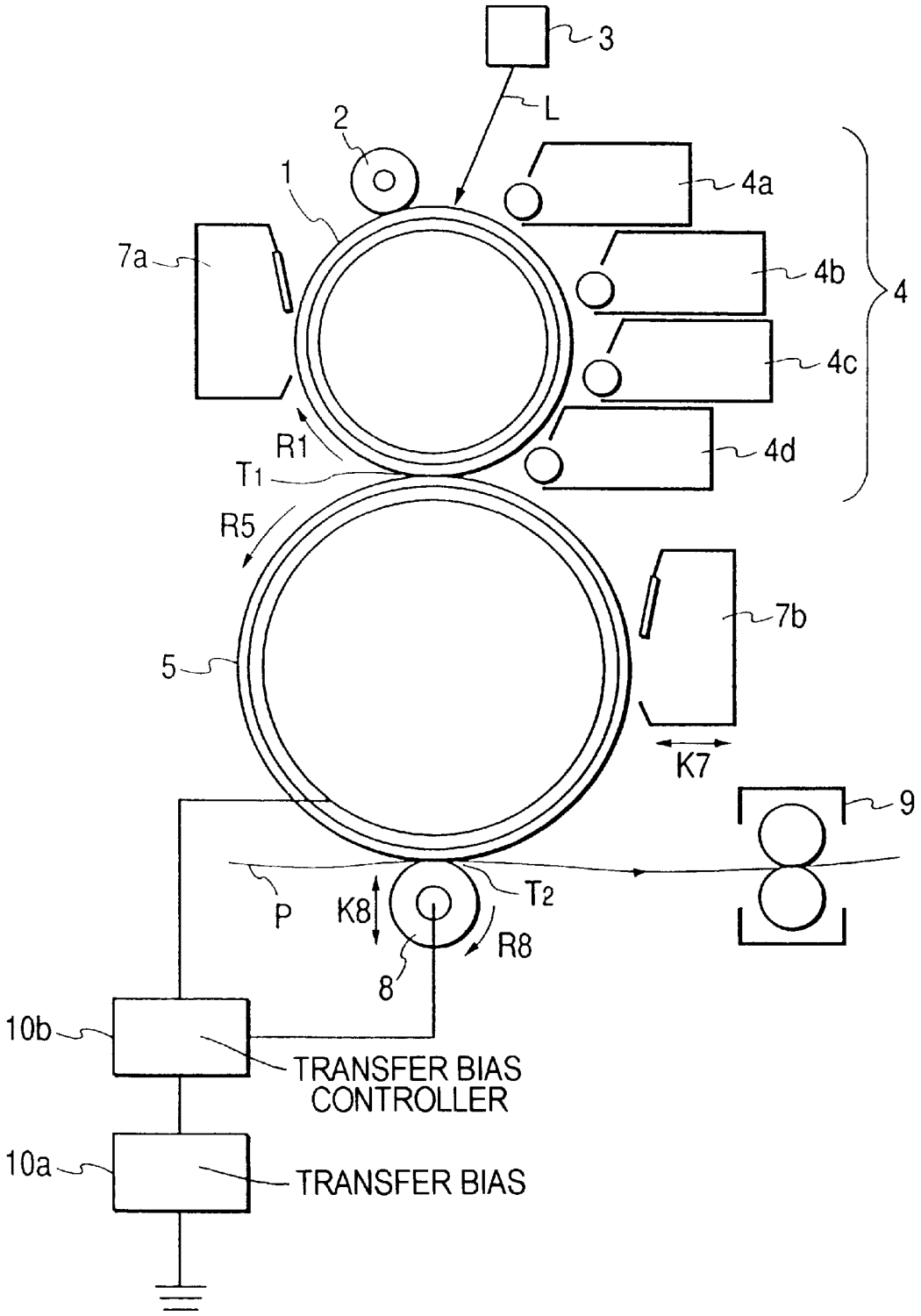
FIG. 5 PRIOR ART
FIG. 5 is a longitudinally sectional view showing the schematic configuration of a conventional image forming apparatus.

In the image forming apparatus shown in FIG. 1, there is employed an intermediate transfer body 5. having electric resistance as high as $10^7$ Ω which is substantially equal to that of the conventional example shown in FIG. 5.

In the image forming apparatus according to this embodiment shown in FIG. 1, the following members mentioned below are added to the conventional image forming apparatus shown in FIG. 5. These members include a circuit (film thickness detecting means) 19 for detecting, respectively, a charging bias voltage value and a current value applied to a charging roller 2 in order to estimate the film thickness of a photosensitive drum 1, a temperature/humidity sensor (temperature/humidity detecting means) 20 for detecting the relative humidity of the image forming apparatus and a state judging circuit (control means) 21 for judging the above noted two detected results and controlling the charging bias applied to the charging roller 2. A reference character 22 shown in FIG. 1 designates a charging bias applied power. A similar one is also provided in the image forming apparatus shown in FIG. 5, however, the illustration thereof is omitted.

With the above described configuration, for example, when a prescribed voltage value is applied to the charging roller 2, an electric current supplied to the charging roller 2 is detected as a parameter associated with the film thickness of the photosensitive drum 1, so that the capacity of the photosensitive drum 1 is estimated and the film thickness is estimated from this capacity. When the state judging circuit 21 judges that the film thickness of the photosensitive drum is a prescribed value or lower (not higher than 60% as thick as the film thickness at the initial time in the present embodiment) and the relative humidity of the image forming apparatus is a prescribed value or higher (70% in the present embodiment) on the basis of the estimated result of the film thickness and the detected result of the temperature/humidity sensor 20, the state judging circuit controls the potential Vd of the photosensitive drum 1 to switch from Vd=−600V as an initial setting value to Vd=−400V as a value for coping with the retransfer phenomenon. More specifically, the charging bias voltage value applied to the charging roller 2 is decreased so that the potential Vd is lowered.

When such a control is carried out, the retransfer phenomenon which is generated by the above described mechanism can be reduced and the generation of poor copy can be prevented.

In this case, although the transfer voltage applied to the intermediate transfer body is set to a prescribed voltage (+300V) irrespective of the detected results of the detecting means 19 and 20, needless to say, the transfer voltage may be switched to Vd=−400V and the absolute value of the transfer voltage may be decreased.

Further, in this embodiment, while the effects of the intermediate transfer body 5 having the resistance value as high as $10^7$ Ω are described, it is recognized that an intermediate transfer body 5 having a resistance value as large as $10^{13}$ Ω may. achieve similar effects to the above. In this case, however, as the resistance of the intermediate transfer body 5 is increased, a level of generating the retransfer phenomenon is lowered, so that the effects according to the present invention are also reduced. As the resistance value of the intermediate transfer body 5 is decreased, the retransfer phenomenon is more readily apt to be generated. As explained in the section of the generation mechanism of the retransfer phenomenon, since the retransfer phenomenon is generated because of the abnormal discharge in the primary transfer nip $T_1$, it may be considered that this abnormal discharge tends to be generated because the resistance of the intermediate transfer body 5 is low. On the other hand, when the transfer characteristic during the secondary transfer is taken into account, the excessively high resistance of the intermediate transfer body 5 is not desirable. The intermediate transfer body 5 having the resistance value as high as $10^{13}$ Ω is preferably used. The intermediate transfer body having the resistance value as high as $10^7$ to $10^{10}$ Ω may be more preferably employed.

Further, in the present embodiment;, although the method for estimating the charging current when the prescribed voltage is applied to the charging roller 2 is described as the method for estimating the film thickness of the photosensitive drum 1, it should be noted that the image forming apparatus has. a. configuration in which charging bias applied time to the charging roller 2 can be integrated and the film thickness can be estimated based on the integrated applied time or, film thickness detecting means for directly measuring the film thickness are provided so as to obtain the similar effects to those mentioned above.

Furthermore, in the present embodiment, although the relative humidity of the image forming apparatus is detected and a control is carried out on the basis of the detected result, it is recognized from the study by the applicant and other staff of the present application that temperature is also detected in addition to the relative humidity, absolute water content is obtained from them and a control is carried out on the basis of the absolute water content so as to achieve more preferable effects.

Second Embodiment

In the above embodiment, although, when the state judging circuit 21 judges that the film thickness of the photosensitive drum 1 is not larger than the. prescribed value and the relative humidity of the image forming apparatus is not lower than the prescribed value, the state judging circuit 21 controls the potential Vd of the photosensitive drum 1 to switch from Vd=−600V as the initial setting value during the formation of images of all colors to Vd=−400V as the value for coping with the retransfer phenomenon, it should be noted, by taking the generation mechanism of the retransfer phenomenon into account, that the absolute value of the potential Vd got when the image of a color initially transferred to the intermediate transfer body 5 is formed on the photosensitive drum 1 is not controlled as in the case of the first embodiment.

Further, in the color image forming apparatus which belongs to the utilization field of the present invention, needless to say, a plurality of developing agents are employed, however, a physical quantity called a "triboelectricity" which indicates a quantity of charge per unit weight of the developing agent is not necessarily equal among the developing agents of a plurality of colors. It is well known to a person with ordinary skill in the art that, when the absolute value of the physical quantity called a triboelectricity is large, developing contrast potential required for developing toner particles of the same quantity needs to be more increased. In other words, when the absolute value of the triboelectricity is large, it is necessary to have large developing contrast potential in order to obtain complete image density.

Thus, in the present embodiment, the image forming apparatus using the intermediate transfer body 5 as shown in the first embodiment is characterized in that, when a plurality of developing agents having different triboelectricity therebetween are used, the developing agent having the largest absolute value of the triboelectricity is employed to form an image of a first color and potential Vd is not changed at the time of forming the latent image of the first color.

With such a configuration of the image forming apparatus, even under a state in which the retransfer phenomenon is generated to enter a mode (mode requiring a measure for coping with the retransfer) as illustrated in the first embodiment, the absolute value of the potential Vd is not decreased as those of other colors upon development of the developing agent with a large triboelectricity, hence a complete developing contrast can be acquired. In case the developing agent with a large triboelectricity is included, the sufficient image density can be obtained while the generation of the retransfer phenomenon is prevented.

Third Embodiment

Figure 4:
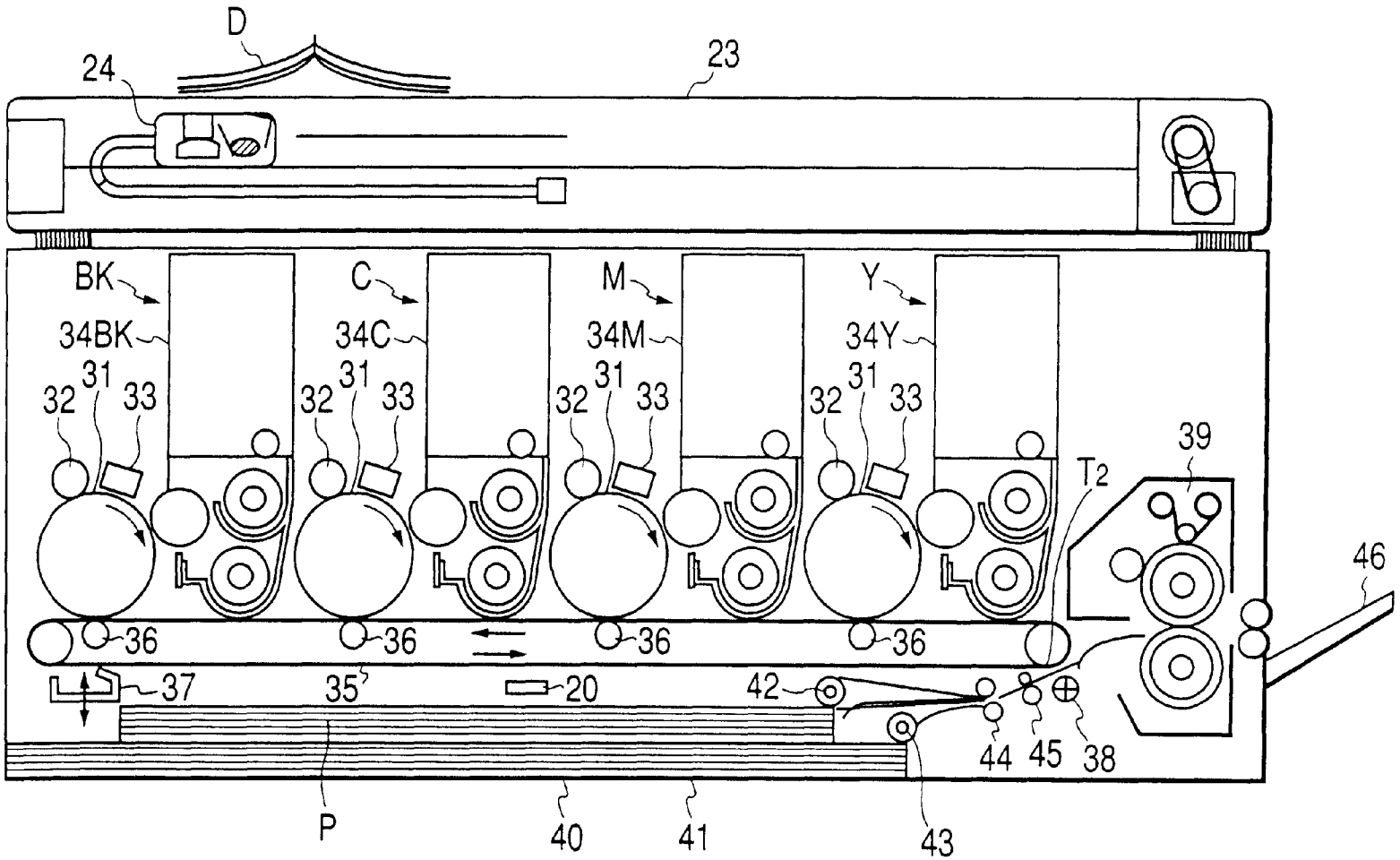
FIG. 4 is a longitudinally sectional view showing the schematic configuration of an image forming apparatus according to a third embodiment of the present invention.

FIG. 4 shows an image forming apparatus according to a third embodiment of the present invention. The present invention can be applied to the image forming apparatus as illustrated in FIG. 4. In this embodiment, a plurality (four shown in FIG. 4) of photosensitive drums 31 are provided as first image bearing bodies. Further, as a second image bearing body, an intermediate transfer belt (intermediate transfer body) 35 is provided.

The image forming apparatus shown in FIG. 4 has independently image forming units Y., M, C and Bk respectively of yellow, magenta, cyan and black and can output full color images including four colors. In the present embodiment, as a developing method, a two-component contact developing method is employed. As a developing agent, toner produced by a polymerization method is mixed with a magnetic carrier and the mixture thus obtained is used. According to the feature of the present embodiment of the invention, since developing devices 34Y, 34M, 34C and 34Bk also serve as cleaning devices in the respective image forming units Y, M, C and Bk, a cleaning device is saved. Further, toner images formed in the respective image forming units Y, M, C and Bk are sequentially subjected to a multiple transfer (primary transfer) on the intermediate transfer belt 35 (intermediate transfer body) as the second image bearing body by primary transfer rollers (first transfer means) 36, then, the images transferred to the transfer belt are simultaneously secondarily transferred to a transfer material P by a secondary transfer roller (second transfer means) 38. Thus, the full color images including four colors are formed.

First of all, the present embodiment of the invention will be described in more detail. Initially, an original copy D is set on an original copy base 23 while a surface having an original image to be copied is directed downward. Then, a copy button is pressed, so that a copying operation is started. The original image is read by a scanner unit 24 and the read color image information including red, green and blue is separated into colors of yellow, magenta, cyan and black and the colors are converted respectively into signals which are sent to a printer part.

In the printer part, the four image forming units Y, M, C and Bk corresponding to the full colors including four colors, namely, for yellow, magenta, cyan and black are arranged. In each of the image forming units, the photosensitive drum 31 as the first image bearing body, a charging roller 32 for uniformly charging the photosensitive drum 31, an LED solid scanner (exposure device) 33 as an image exposing system for forming an electrostatic latent image on the photosensitive drum 31 and a developer 34Y, 34M, 34C or 34Bk for developing the electrostatic latent image thus formed with toner particles, and the primary transfer roller 36 as the first transfer means for transferring the toner image onto the intermediate transfer belt 35 in an electrostatic way.

When a yellow image signal is sent to the printer part, the surface of the photosensitive drum 31 previously charged by the charging roller 32 is irradiated with an optical signal corresponding to the yellow image signal by the LED solid scanner 33 to form an electrostatic image in the image forming unit Y for yellow. This electrostatic latent image is developed by the developer 34Y in which yellow toner is contained so that the yellow toner image is formed on the surface of the photosensitive drum 31. This yellow toner image is primarily transferred to the intermediate transfer belt 35 by the primary transfer roller 36. In the image forming unit M for magenta, the surface of the photosensitive drum 31 is irradiated with an optical signal corresponding to the magenta image signal simultaneously with the above operation, so that an electrostatic latent image is formed thereon. The electrostatic latent image is developed by the developer 34M in which the magenta toner is contained to form a magenta toner image on the photosensitive drum 31. The magenta toner image formed in such a manner is primarily transferred onto the intermediate transfer belt 35 on which the yellow toner image has been already formed so as to be superposed thereon. Further, similar processes to those mentioned above are carried out for cyan and black, hence the toner images of four colors are superposed together on the intermediate transfer belt 35 to form color images.

In the meantime, the transfer material P is taken out from a sheet feed cassette 40 or a sheet feed cassette 41 by a pick-up roller 42 or a pick-up roller 43, conveyed by a pair of conveying rollers 44 and fed to a secondary transfer nip $T_2$ synchronously with the color images formed on the intermediate transfer belt 35 by a pair of resist rollers. 45. This secondary transfer nip $T_2$ is formed by the intermediate transfer belt 35 and the secondary transfer roller 38 abutting against the intermediate transfer belt 35. After the toner images of four colors (color images) on the intermediate transfer belt 35 are simultaneously subjected to a secondary transfer and then, the color images are fixed to the transfer material by a fixing device 39, the transfer material P fed to the secondary transfer nip $T_2$ is discharged to a sheet discharging tray 46. Toner (remaining toner after the secondary transfer) which is not transferred to the transfer material P and remains on the surface of the intermediate transfer belt 35 is removed by an intermediate transfer body cleaning device 37 after the toner images are transferred to the intermediate transfer belt 35.

In the present embodiment, a temperature/humidity sensor 20 capable of measuring the temperature and humidity is provided in an image forming apparatus main body M similarly to the above first embodiment. Further, film thickness detecting means (not shown in FIG. 4, see FIG. 1) for detecting the film thickness of the photosensitive drum 31 is provided. The film thickness detecting means is provided for the photosensitive drums 31 after the image forming unit M for the second color of magenta to achieve satisfactory advantages, from the reasons described in the above second embodiment.

With such a configuration of the image forming apparatus, the absolute value of potential Vd is controlled to be decreased for the image forming unit in which it is decided that the retransfer phenomenon prominently tends to be generated on the basis of the detected result of the temperature/humidity sensor 20 and the detected result of the film thickness of each photosensitive drum 31. In the present embodiment, the generation of the retransfer phenomenon can be prevented under such a control, and good images can be formed in a similar manner to that of the first embodiment.

What is claimed is:

1. An image forming apparatus comprising:

an image bearing body;

electrostatic image forming means for forming an electrostatic image on said image bearing body;

developing means for reversal-developing the electrostatic image with toner and forming a toner image;

an intermediate transfer body, wherein the toner image is transferred from said intermediate transfer body to a transfer material after the toner image is electrostatically transferred from said image bearing body directly onto said intermediate transfer body, and voltage is applied to said intermediate transfer body when the toner image is transferred from said image bearing body to said intermediate transfer body, said intermediate transfer body capable of transferring a second color toner image after a first color toner image has been transferred;

detecting means for detecting parameters associated with a thickness of a layer of said image bearing body; and control means for controlling variably a target potential of a shadow portion of the electrostatic image for said second color toner image so that a potential difference between the target potential of the shadow portion of the electrostatic image for said second color toner image and the voltage for said second color toner image can be varied on the basis of a detected result of said detecting means.

2. The image forming apparatus according to claim 1, wherein said developing means forms the toner image having a plurality of colors one color by one color on said image bearing body, and the toner image of the plurality of colors is transferred from said intermediate transfer body to the transfer material after being transferred one color by one color to said intermediate transfer body.

3. The image forming apparatus according to claim 1, wherein said image bearing body is provided plurally, said developing means forms the toner images having a plurality of colors one color by one color on the plurality of image bearing bodies, the toner images of the plurality of colors are transferred from said intermediate transfer body to the transfer material after being transferred from the plurality of image bearing bodies to said intermediate transfer body.

4. The image forming apparatus according to claim 2 or 3, wherein said control means controls the target potential of the shadow portion of the electrostatic image for the toner images except the toner image of a first color among the toner images having a plurality of colors.

5. The image forming apparatus according to claim 1, wherein said control means controls an absolute value of the target potential of the shadow portion of the electrostatic image for said second color toner image to be small when the thickness of the layer of the image bearing body is decreased depending on the detected result of said detecting means.

6. The image forming apparatus according to claim 1 or 5, further comprising environment detecting means for detecting an atmospheric environment in said apparatus, wherein said control means controls the target potential of the shadow portion of the electrostatic image for said second color toner image to be variable so that the target potential difference between the potential of the shadow portion of the electrostatic image for said second color toner image and the voltage can be varied on the basis of a detected result of said environment detecting means.

7. The image forming apparatus according to claim 6, wherein said control means controls the absolute value of the target potential of the shadow portion of the electrostatic image for said second color toner image to be decreased when humidity is high on the basis of the detected result of said environment detecting means.

8. The image forming apparatus according to claim 2 or 3, wherein a sequence of transfer is set so that toner image in which an absolute value of electric charge amount per unit weight of toner is maximum among the toner images having a plurality of colors is first transferred to said intermediate transfer body.

9. The image forming apparatus according to claim 1, wherein said electrostatic image forming means has a charging member capable of contacting with said image bearing body and the parameters indicate an electric current flowing in the charging member when a predetermined voltage is applied to the charging member.

10. The image forming apparatus according to claim 1, wherein a resistance of said intermediate transfer body is $10^{13}$ Ω or lower.

11. An image forming apparatus according to claim 1, wherein said control means controls variably a target potential of a shadow portion of the electrostatic image for each color toner image so that a potential difference between the target potential of the shadow portion of the electrostatic image for each color toner image and the voltage for each color toner image can be varied on the basis of a detected result of said detecting means.

12. An image forming apparatus comprising:

an image bearing body;

electrostatic image forming means for forming an electrostatic image on said image bearing body;

developing means for reversal-developing the electrostatic image with toner and forming a toner image;

an intermediate transfer body, wherein the toner image is transferred from said intermediate transfer body to a transfer material after the toner image is electrostatically transferred from said image bearing body directly onto said intermediate transfer body, and voltage is applied to said intermediate transfer body when the toner image is transferred from said image bearing body to said intermediate transfer body, said intermediate transfer body capable of being transferred a second color toner image after a first color toner image being transferred;

environment detecting means for detecting an atmospheric environment in said apparatus; and control means for controlling variably a target potential of a shadow portion of the electrostatic image for said second color toner image so that a potential difference between the target potential of the shadow portion of the electrostatic image for said second color toner image and the voltage for said second color toner image can be varied on the basis of a detected result of said environment detecting means.

13. The apparatus according to claim 12, wherein said developing means forms the toner image having a plurality of colors one color by one color on said image bearing body, and the toner image of the plurality of colors is transferred from said intermediate transfer body to the transfer material after being transferred one color by one color to said intermediate transfer body.

14. The image forming apparatus according to claim 12, wherein said image bearing body is provided plurally, said developing means forms the toner images having a plurality of colors one color by one color on the plurality of image bearing bodies, the toner images of the plurality of colors are transferred from said intermediate transfer body to the transfer material after being transferred from the plurality of image bearing bodies to said intermediate transfer body.

15. The image forming apparatus according to claim 13 or 14, wherein said control means controls the target potential of the shadow portion of the electrostatic image for the toner images except the toner image of a first color among the toner images having a plurality of colors.

16. The image forming apparatus according to claim 12, wherein said control means controls an absolute value of the potential of the shadow portion of the electrostatic image for said second color toner image to be decreased when humidity is high on the basis of the detected result of said environment detecting means.

17. The image forming apparatus according to claim 13 or 14, wherein a sequence of transfer is set so that toner image in which an absolute value of electric charge amount per unit weight of toner is maximum among the toner images having a plurality of colors is first transferred to said intermediate transfer body.

18. The image forming apparatus according to claim 12, wherein said electrostatic image forming means has a charging member capable of contacting with said image bearing body and the parameters indicate an electric current flowing in the charging member when a predetermined voltage is applied to the charging member.

19. The image forming apparatus according to claim 12, wherein a resistance of said intermediate transfer body is $10^{13}$ Ω or lower.

20. An image forming apparatus according to claim 12, wherein said control means controls variably a target potential of a shadow portion of the electrostatic image for each color toner image so that a potential difference between the target potential of the shadow portion of the electrostatic image for each color toner image and the voltage for each color toner image can be varied on the basis of a detected result of said environment detecting means.

* * * * *

UNITED STATES PATENT AND TRADEMARK OFFICE

CERTIFICATE OF CORRECTION

PATENT NO. : 6,421,508 B2 
DATED : July 16, 2002
INVENTOR(S) : Masahiro Inoue et al.

It is certified that error appears in the above-identified patent and that said Letters Patent is hereby corrected as shown below:

Column 4,
Line 23, “lob” should read -- 10b --.

Column 6,
Line 31, “vs(Q/m$^2$),” should read -- σs(Q/m$^2$), --;
Line 54, “the.” should read -- the --; and
Line 57, “as” should read -- σs --.

Column 7,
Line 55, “may.” should read -- may --.

Column 8,
Line 13, “has. a.” should read -- has a --; and
Line 31, “the.” should read -- the --.

Signed and Sealed this

Thirty-first Day of December, 2002

JAMES E. ROGAN
*Director of the United States Patent and Trademark Office*